United States Patent [19]

Dutescu

[11] Patent Number: 4,708,637

[45] Date of Patent: Nov. 24, 1987

[54] GASEOUS FUEL REACTOR

[76] Inventor: Cornel J. Dutescu, 10101 Southwest Freeway, #200, Houston, Tex. 77074

[21] Appl. No.: 855,076

[22] Filed: Apr. 22, 1986

[51] Int. Cl.[4] ..... F23D 14/00; F23L 1/00

[52] U.S. Cl. ..... 431/116; 431/158; 431/352; 239/429; 239/434

[58] Field of Search ..... 431/9, 10, 116, 181, 431/187, 284, 158, 350, 351, 352, 7; 239/427, 427.3, 427.5, 428, 429, 430, 431, 433, 434

[56] References Cited

U.S. PATENT DOCUMENTS

| | | | |
|---|---|---|---|
| 2,417,445 | 3/1947 | Pinkel | 239/427.5 |
| 2,482,260 | 9/1949 | Goddard | 239/429 |
| 2,973,727 | 3/1961 | Northcote | 431/284 X |
| 2,973,808 | 3/1961 | Fox | 431/116 |
| 3,007,512 | 11/1961 | Te Nuyl | 158/11 |
| 3,376,098 | 4/1968 | Pryor | 431/10 |
| 3,520,646 | 7/1970 | Matsuda | 431/187 |
| 3,529,917 | 9/1970 | Hindenlang | 431/351 |
| 3,604,824 | 9/1971 | Hardison | 431/116 |
| 3,733,165 | 5/1973 | Nakagawa | 431/10 |
| 3,838,652 | 10/1974 | Schol | 110/49 |
| 4,123,220 | 10/1978 | Bond | 431/353 |
| 4,130,388 | 12/1978 | Flanagan | 431/116 |
| 4,345,426 | 8/1982 | Egnell et al. | 431/116 X |
| 4,395,223 | 7/1983 | Okigami | 431/10 |
| 4,523,530 | 6/1985 | Kaminaka et al. | 110/264 |

FOREIGN PATENT DOCUMENTS

| | | | |
|---|---|---|---|
| 1350449 | 12/1963 | France | 431/284 |

*Primary Examiner*—Margaret A. Focarino
*Attorney, Agent, or Firm*—Arnold, White & Durkee

[57] ABSTRACT

A gaseous fuel reactor is formed from a plurality of concentric casings which form a primary air chamber, a secondary air chamber, a combustion chamber, a gas distribution chamber, and a tertiary air chamber. The flow of gas and air through the various chambers interact to provide controlled flame characteristics. Additionally, the flame is maintained at a lower temperature to avoid the formation of pollutants.

15 Claims, 3 Drawing Figures

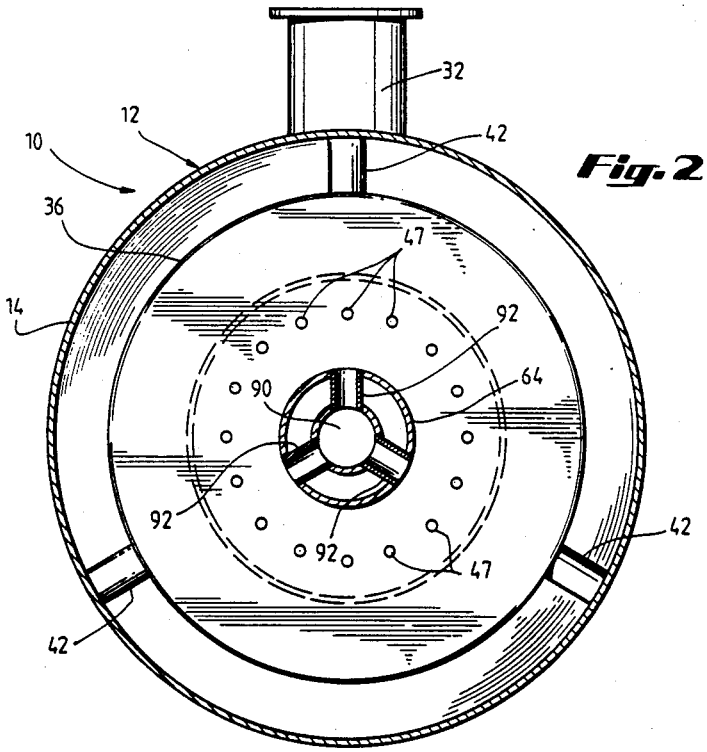
Fig. 2
Fig. 3
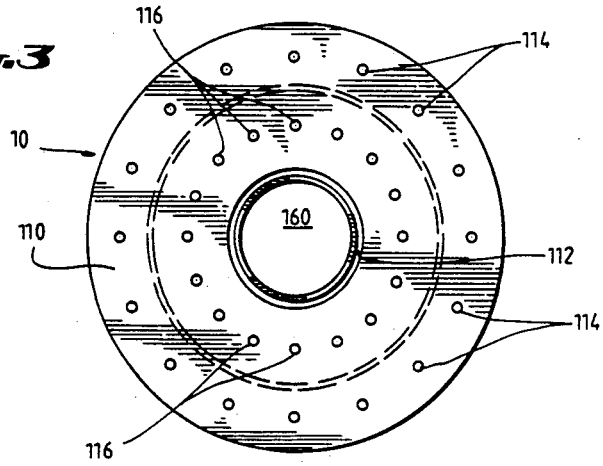

GASEOUS FUEL REACTOR

BACKGROUND

The present invention relates to fuel burners such as are used in industrial furnaces. More particularly, the present invention relates to fuel reactors wherein the combustion process is regulated to control the flame characteristics.

It is very difficult to design and build efficient furnaces when efficient burners are not available. For many years people have tried to develop combustion methods capable of effectively controlling the formation of pollutants such as nitrogen oxides ($NO_x$) which in turn oroduce photochemical oxidants. However, a furnace design cannot control the pollution emissions. These must be controlled in the burner.

A high flame temperature in the burner will create the optimum condition for the atomic nitrogen in the combustion air to combine with the oxyqen. Once NO is formed, the poisonous $NO_2$ is unavoidable.

One method which has been tried to eliminate the formation of $NO_x$ is to maintain a low flame temperature. However, in most cases the methods which have been developed cause imperfect combustion thus generating carbon monoxide, another deadly pollutant.

Another problem associated with many types of conventional fuel burners is their inefficiency which can result in incomplete combustion. This often gives rise to soot deposits in the flue and also in the discharge of particulate matter into the atmosphere.

Another problem associated with conventional fuel burners is the lack of control over the momentum of the flame. Many burners are nothing more than a large torch and it is difficult to control the direction and amplitude of the flame. This causes problems in furnace design where the flame momentum must he known in order to efficiently design the size and configuration of the furnace.

In view of the foregoing it is apparent that what is needed in the art is a fuel reactor which maintains a lower temperature to avoid the formation of nitrogen oxides while maintaining complete combustion of the reactants. It is also evident that it would be a significant advancement in the art to provide a fuel reactor which permits control of the flame characteristics such as the flame momentum. Such a reactor is disclosed and claimed herein.

SUMMARY OF THE INVENTION

The present invention provides a gaseous fuel reactor which maintains a low flame temperature to reduce the number of pollutants formed and also provides controlled flame characteristics.

The reactor is basically formed from a plurality of concentric casings forming a series of chambers. The outer chamber is used as a primary air chamber and includes an air inlet. A secondary air chamber is formed within the primary air chamber and is concentric with it. A plurality of ports in the downstream portion of the casing between the primary and secondary air chambers permits the air to flow from the primary chamber to the secondary chamber.

A combustion chamber is formed concentrically within the secondary air chamber. A plurality of ports through the wall between the secondary air chamber and the combustion chamber allow air to pass into the combustion chamber. A gas distribution manifold is positioned within the combustion chamber so as to form an additional chamber. Ports in the cas distribution manifold permit gas to enter the combustion chamber where it can mix with the air for combustion.

A cylindrical conduit is positioned axially within the gas distribution manifold to form a tertiary air chamber. The tertiary air chamber is connected with the primary air chamber by means of a plurality of passageways extending through the sides of the gas distribution manifold.

The forward end of the combustion chamber is generally conical in shape to form a deflection chamber. A generally cylindrical nozzle is formed on the downstream end of the deflection chamber.

A plurality of ports are formed in the walls of the deflection chamber to permit a portion of the combustion products to flow into the secondary air chamber to preheat the air. Additionally, a plurality of ports are formed in the wall of the nozzle to permit the air from the secondary air chamber to pass therethrough to cool the surfaces of the nozzle as the flame exits. The downstream face of the secondary air chamber and the primary air chamber also include a plurality of ports permitting air to exit therefrom to cool the face of the fuel reactor.

In operation, gas is introduced into the fuel reactor through the gas distribution manifold. The gas exits through the ports into the combustion chamber. The ports are formed in arrays and at an angle facing downstream so as to provide some momentum to carry the reaction products out of the fuel reactor.

Air is introduced into the primary air chamber where a portion of it is directed into the secondary air chamber through the ports separating the primary and secondary air chambers. A portion of the air is directed into the tertiary air chamber. The air ports between the secondary air chamber and the combustion chamber are arranged in arrays and are aligned such that they generally coincide with the gas ports in the gas distribution manifold. Accordingly, each port in the gas distribution manifold corresponds to a port between the secondary air chamber and the combustion chamber. These ports are aligned such that gas and air impinge each other substantially along the center line of the combustion chamber.

Additionally, an air inlet port is formed in the back wall of the combustion chamber to permit air to pass from the primary air chamber into the combustion alonc its center line. This air stream provides momentum to carry the combustion products out of the reactor and serves to initially cool the flame. As the combustion products exit from the combustion chamber they strike the walls of the deflection chamber whereby they are directed towards the nozzle. The air from the tertiary air chamber joins the combustion products at this point to provide sufficient oxygen to ensure complete combustion of all of the fuel and to provide a additional momentum to the combustion products as they exit the reactor through the nozzle.

BRIEF DESCRIPTION OF THE DRAWINGS

FIG. 2 is a cross-sectional view of the reactor of the present invention taken at the position indicated by line 2—2 of FIG. 1.

FIG. 3 is a cross-sectional view of the reactor of the present invention taken at the position indicated by line 3—3 of FIG. 1.

DETAILED DESCRIPTION OF THE PREFERRED EMBODIMENTS

Figure 1:
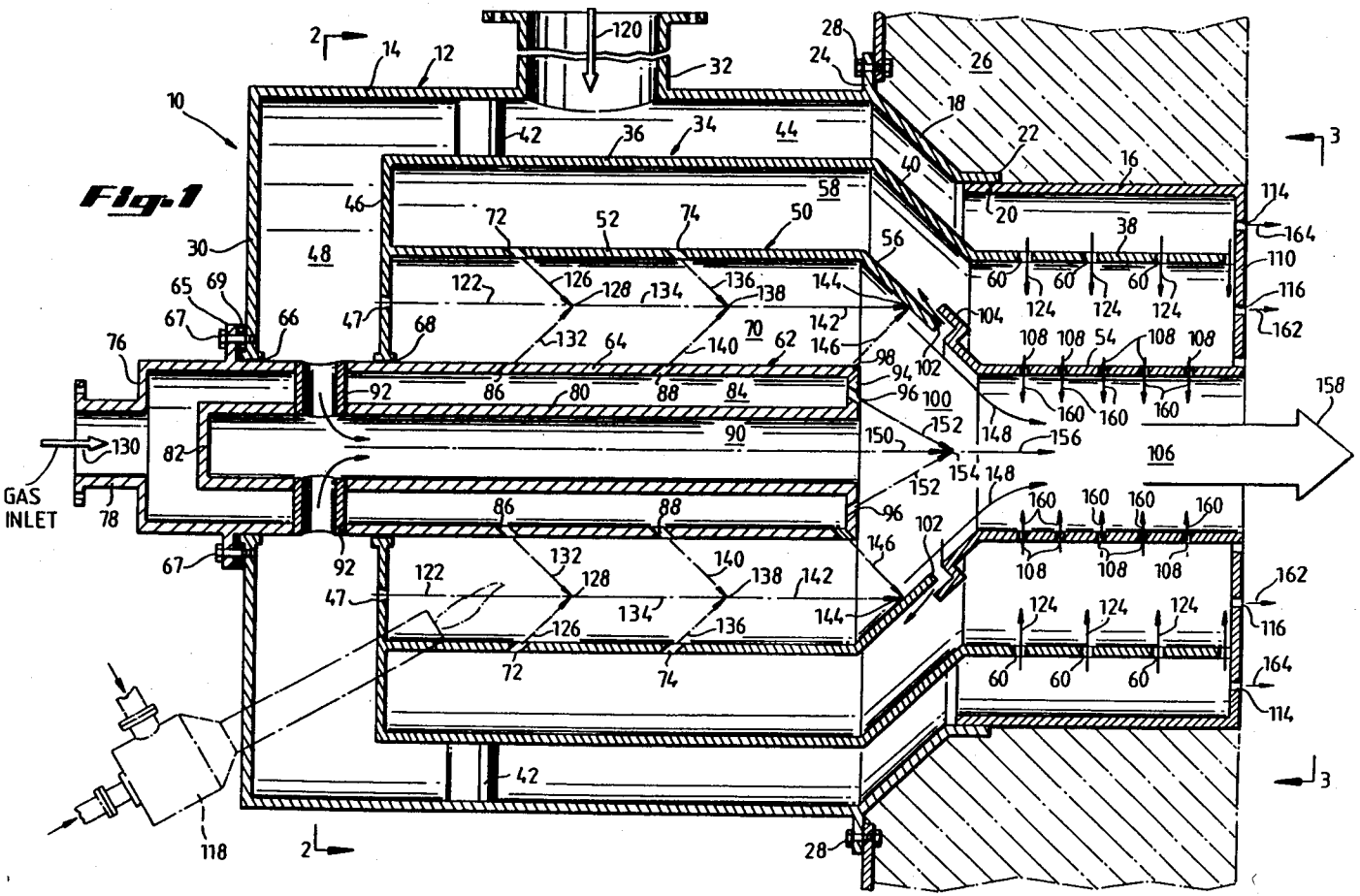
FIG. 1 is a cross-sectional view of a preferred embodiment of the fuel reactor of the present invention shown mounted in the wall of a furnace.

The present invention provides a gaseous fuel reactor which maintains a low flame temperature to reduce the amount of pollutants which are formed and also provides controlled flame characteristics. The invention is best understood by reference to the accompanying drawings in which like parts are designated with like numerals throughout.

Referring first to FIG. 1, a preferred embodiment of the reactor of the present invention is generally designated at 10. Reactor 10 includes an outer casing 12.

Outer casing 12 includes a cylindrical portion 14, a cylindrical portion of reduced diameter 16, and a conical portion 18 connecting the two cylindrical portions. Outer casing 12 includes an expansion joint 20 between cylindrical portion of reduced diameter 16 and conical portion 18. Conical portion 16 is designed so that it can freely slide within flange 22 formed on the end of conical portion 18.

A flange 24 is formed around cylindrical portion 14 such that reactor 10 can be mounted in a furnace wall 26 by means of bolts 28. In the preferred embodiment, reactor 10 and furnace wall 26 are designed such that conical portion 18 and cylindrical portion 16 fit within wall 26.

Outer casing 12 includes a rear wall 30 mounted on the rear end of cylindrical portion 14.

A conduit 32 is attached to outer casing 12 to provide an inlet whereby air can be introduced into reactor 10.

A first casing 34 is concentrically positioned within outer casing 12. First casing 34 includes a cylindrical portion 36, a cylindrical portion of reduced diameter 38, and a conical portion 40 connecting cylindrical portions 36 and 38. First casing 34 is positioned within casing 12 by means of spacers 42. In the preferred embodiment, three spacers 42 are utilized.

A primary air chamber 44 is formed between outer casing 12 and first casing 34. A rear wall 46 is positioned on the back of cylindrical portion 36 of first casing 34. Rear wall 46 is spaced from wall 30 on outer shell 12 so as to form a rear air chamber 48.

A second casing 50 is concentrically positioned within first casing 34. Second casing 50 includes a cylindrical portion 52, a cylindrical portion 54 of reduced diameter, and a conical portion 56 connecting cylindrical portions 52 and 54. A secondary air chamber 58 is formed between second casing 50 and first casing 34.

A plurality of ports 60 are formed in cylindrical portion 38 of first casing 34 to permit air to flow between primary air chamber 44 and secondary air chamber 58.

Cylindrical portion 52 of second casing 50 is attached to rear wall 46. A circular array of ports 47 are formed in rear wall 46.

A gas distribution manifold 62 is concentrically positioned within outer casing 12 and second casing 50. Gas distribution manifold 62 is formed from a cylindrical casing 64 which extends through aperture 66 in rear wall 30 and aperture 68 in rear wall 46. A combustion chamber 70 is formed between cylindrical casing 64 and cylindrical portion 52 of second casing 50.

A first array of ports 72 are formed in cylindrical portion 52 of second casing 50 to connect secondary air chamber 58 with combustion chamber 70. A second array of ports 74 are also formed in cylindrical portion 52 of casing 50, downstream of ports 72, to connect secondary air chamber 58 with combustion chamber 70.

A flange 65 is attached to gas distribution manifold 62 for holding manifold 62 within outer casing 12. A plurality of bolts 67 extend through flange 67 and into rear wall 30 of outer casing 12. A gasket 69 is provided between flange 67 and wall 30 to prevent air from escaping through aperture 68.

A rear wall 76 is formed on the back end of gas distribution manifold 62. A conduit 78 is formed within rear wall 76 to permit gas to enter manifold 62.

A cylindrical casing 80 is positioned within gas distribution manifold 62. A rear wall 82 is positioned on the back end of cylindrical casing 80. Casing 80 and gas distribution manifold 62 define a gas distribution chamber 84.

A first array of ports 86 are formed in cylindrical casing 64 to connect gas distribution chamber 84 with combustion chamber 70. Ports 86 are designed to correspond to ports 72 formed in cylindrical portion 52 of second casing 50.

A second array of ports 88 are also formed in cylindrical casing 64 to connect gas distribution chamber 84 with combustion chamber 70. Ports 88 correspond to ports 74 in second casing 50.

The interior of cylindrical casing 80 defines a tertiary air chamber 90. Tertiary air chamber 90 is connected by means of conduits 92 with rear air chamber 48. In the preferred embodiment, three conduits 92 are utilized. However, it will be appreciated by those skilled in the art that any number could be used depending upon the gas and air flow requirements of reactor 10.

A front wall 94 is connected to cylindrical casing 80 to form the front of gas distribution chamber 84. A plurality of gas ports 96 are formed in front wall 94. Additionally, front wall 94 is spaced from cylindrical casing 64 to form an annular opening 98. Ports 96 and annular opening 98 are all directed into deflection chamber 100 which is formed by conical portion 56 of second casing 50.

A plurality of ports 102 are formed in conical portion 56 to permit a portion of the combustion products to recirculate from deflection chamber 100 into secondary air chamber 58. A ring 104 is positioned on the outer surface of conical portion 56 around ports 102 to prevent air from passing from secondary air chamber 58 into deflection chamber 100 through ports 102.

Cylindrical portion 54 of second casing 50 forms a nozzle 106 in front of deflection chamber 100. A plurality of ports 108 are formed in cylindrical portion 54 to permit air from secondary air chamber 58 to pass into and cool the sides of nozzle 106. While nozzle 106 has been represented as having a generally cylindrical shape, other shapes, such as conical, can also be used.

A front plate 110 is connected to cylindrical portion 16 of outer casing 12 to form a front wall for primary air chamber 44 and secondary air chamber 58. Front plate 110 is not secured to cylindrical portion 54 which forms the sides of nozzle 106 such that an expansion joint 112 is formed.

A plurality of ports 114 are formed in front plate 110 such that they are in communication with primary air chamber 44. Additionally, a plurality of ports 116 are formed in front plate 110 such that they are in communication with secondary air chamber 58. Ports 114 and 116 cooperate to permit air to leave primary air chamber 54 and secondary air chamber 58 to cool the front of reactor 10.

A pilot, schematically illustrated at 118, is positioned in the rear of reactor 10 for initiating combustion. Pilot 118 extends throuch rear walls 30 and 46 and into combustion chamber 70. Many types of pilots such as are well known to those skilled in the art can be used with reactor 10 of the present invention. Additionally, a miniature version of reactor 10 can be utilized as the pilot.

In operation, air is introduced into reactor 10 through conduit 32 as represented by arrow 120. The air enters primary air chamber 44 where a portion of it is directed to rear air chamber 48. A portion of the air in rear chamber 48 enters combustion chamber 70 through the circular array of ports 47. This air enters along the center line of combustion chamber 70. The air can be treated as a collection of moving particles which create a first series of vectors as illustrated by arrows 122.

Another portion of the air which enters through conduit 32 is directed towards the forward end of primary air chamber 44. At this point, the air passes through ports 60 into secondary air chamber 58 as illustrated by arrows 124. The air then travels to the rear portion of secondary air chamber 58 where it passes into combustion chamber 70 through the first array of ports 72 and the second array of ports 74. The air entering through the first array of ports 72 forms a series of vectors 126 which impinge vectors 122 at point 128.

Gas enters reactor 10 through conduit 78 as indicated by arrow 130. The gas is directed into gas distribution chamber 84 where a first portion of the gas is directed into combustion chamber 70 through the first array of ports 86. The gas passing through ports 86 forms a series of vectors 132 which impinge vectors 122 and 126 at point 128. The mixture of gas and air are ignited at this point by pilot 118.

In the preferred embodiment, ports 72 and 86 are sized and the air and gas pressures are regulated such that vectors 126 and 132 are in approximately stoichiometric amounts. Accordingly, vector 122 provides excess air to point 128.

The annular area connecting points 128 defines a first combustion zone. Vectors 122, 126, and 132 all combine to form a first resultant vector 134. The function of the series of vectors 122 is to cool the flame or quench the reaction generated by ignition and burning of the mixture of vectors 126 and 132 and to remove a percentage of the unburned gas particles by pushing them forward, away from the first combustion zone.

The resultant vector 134 will contain some unburned hydrocarbons, combustion products (mostly water and carbon dioxide), some free atomic nitrogen and a large amount of excess air.

The air passing through the second array of ports 74 in casing 50 forms a series of vectors 136 which impinge resultant vector 134 at 138. The gas exiting from gas distribution chamber 84 through the second array of ports 88 forms a series of vectors 140 which impinge vectors 134 and 136 at point 138. The area connecting points 138 creates a second combustion zone.

The first hydrocarbon particles that will ignite in the second combustion zone are those particles that escaped ignition during the first combustion zone. These particles were preheated as they traveled with vector 134. Additionally, the gas entering combustion chamber 70 as vectors 140 combines with air vectors 136 to combust in the second combustion zone.

Vectors 134 have a quenching effect on the second combustion zone and help drive all of the particles forward to form a series of resultant vectors 142. Resultant vectors 142 are parallel to resultant vectors 134 but of a larger amplitude because of the addition of vectors 136 and 140.

While the preferred embodiment has been illustrated with two combustion zones. It will be appreciated that any number of combustion zones could be formed by providing the approoriate arrays of ports in casing 50 and gas manifold 62. Additionally, in the preferred embodiment, all of the ports have a circular cross-section. However, other shapes can also be used.

Vectors 142 will impinge conical portion 56 of casing 50 at 144. Gas exitinc from gas distribution chamber 84 through annular opening 98 creates a stream of gas 146 which also impinqes conical portion 56 at 144. This gas is then combusted with the unused oxygen from vector 142. The resultant products are deflected by conical portion 56 towards nozzle 106 as indicated by arrows 148.

Another portion of air from rear air chamber 48 is directed through conduits 92 into tertiary air chamber 90. This air forms a vector 150 which discharqes into deflection chamber 100. Gas exits from gas distribution chamber 84 through the circular array of ports 96 in frcnt wall 94. This gas forms a series of vectors 152 which impinge air vector 150 at point 154. The gas and air combust to form a resultant vector 156. Resultant vector 156 joins with vectors 148 to form combustion jet 158 which exits through the front of nozzle 106.

A portion of vectors 148 are inspirated through ports 102 in conical portion 56 of casing 50 and are recycled with the air through secondary air chamber 58. These particles serve to preheat the air in secondary air chamber 58 before it enters combustion chamber 70.

A portion of the air in secondary air chamber 58 passes through ports 108 in cylindrical portion 54 as represented by arrows 160. This air forms a thin film along the edce of nozzle 106 to cool cylindrical portion from combustion jet 158.

Additionally, a portion of the air in secondary air chamber 58 exits through ports 116 in face 110 as indicated by arrows 116 and a portion of the air in primary air chamber 44 exits through ports 114 as indicated by arrows 164 to cool face 110 of reactor 10.

As reactor 10 is fired up, expansion joints 22 and 112 allow the front end of the reactor to expand so as to prevent unnecessary stresses in the reactor. Additionally, at high firing rates, cylindrical casing 80 can expand forward. This causes annular opening 98 to increase in size to permit a higher flow rate of gas. At a low firing rate, annular opening 98 decreases in size.

As can be seen from the foregoing, the present invention provides a novel fuel reactor which maintains a low flame temperature to avoid the formation of pollutants while achieving complete combustion through use of a long residence time and multiple stage combustion. Additionally, the gas particles are directed on designated angles so that the discharge jet velocity and therefore the flame momentum can be accurately controlled.

While the present invention has been described with reference to the presently preferred embodiment, it will be appreciated that the invention may be embodied in other specific forms without departing from its spirit or essential characteristics. For example, with some variations, reactor 10 can be adapted to burn liquid or solid fuels. Accordingly, the described embodiment is to be considered in all respects only as illustrative and not restrictive. The scope of the invention is, therefore, indicated by the appended claims rather than by the foregoing description. All modifications or changes which come within the meaning and range of equivalency of the claims are to be embraced within their scope.

What is claimed is:

1. A fuel reactor comprising a plurality of concentric casings defining a plurality of concentric chambers including:

a combustion chamber;

a gas distribution chamber axially positioned within said combustion chamber, said gas distribution chamber including a plurality of ports connecting said gas distribution chamber with said combustion chamber;

a secondary air chamber surrounding said combustion chamber, said secondary air chamber having a plurality of ports connecting said secondary air chamber with said combustion chamber; and a primary air chamber surrounding said secondary air chamber;

wherein said ports between said gas distribution chamber and said combustion chamber and said ports between said secondary air chamber and said combustion chamber are formed in corresponding circumferential arrays such that gas and air passing therethrough collide along the center line of the combustion chamber.

2. A fuel reactor as defined in claim 1 wherein said combustion chamber includes a rear wall having a circular array of ports connecting said chamber with said primary air chamber for admitting air substantially along the center line of the combustion chamber.

3. A fuel reactor as defined in claim 2, further comprising a deflection chamber formed at a front end of said combustion chamber for directing combustion products from said combustion chamber into a nozzle.

4. A fuel reactor as defined in claim 3, further comprising means for recirculating combustion products from said deflection chamber to said secondary air chamber so as to preheat air therein.

5. A fuel reactor as defined in claim 3, wherein said nozzle is generally cylindrical in shape.

6. A fuel reactor as defined in claim 3, wherein said nozzle is generally conical in shape.

7. A fuel reactor as defined in claim 3, further comprising a front plate surrounding and generally perpendicular to said nozzle, said front plate forming a front end of said primary and secondary air chambers.

8. A fuel reactor as defined in claim 7, further comprising air ports formed in said front plate to allow air from said primary and secondary air chambers to exit and cool the front of said nozzle.

9. A fuel reactor as defined in claim 3, further comprising means connecting said secondary air chamber and said nozzle to permit secondary air to pass into said nozzle to cool the sides thereof.

10. A fuel reactor comprising:

a combustion chamber formed from concentric casings and a back wall;

a gas distribution chamber concentric with said combustion chamber and including a first array of gas ports formed in the casing between said gas distribution chamber and said combustion chamber;

an air distribution chamber concentric with said combustion chamber on an opposite side of said gas distribution chamber, said air distribution chamber including a first array of air ports formed in the casing between said air distribution chamber and the combustion chamber, said array being aligned with the first array of gas ports for creating a first combustion zone;

a plurality of air inlet ports in said back wall of said combustion chamber for admitting air substantially along the center line of said combustion chamber, air entering therein serving to cool the combustion products in said first combustion zone and forcing said combustion products substantially along the center line of the combustion chamber.

11. A fuel reactor as defined in claim 10, further comprising a second array of air ports and a second array of gas ports downstream from said first arrays, said second arrays forming a second combustion zone.

12. A fuel reactor as defined in claim 11, further comprising a generally conical deflection chamber formed from a conical member positioned on the downstream end of the outer concentric casing of the combustion chamber.

13. A fuel reactor as defined in claim 12, further comprising an annular opening in the end of said gas distribution chamber, said annular opening being aligned such that gas exiting therefrom is focused at the point where the center line of said combustion chamber intersects said conical member of said deflection chamber.

14. A fuel reactor as defined in claim 13, wherein said annular opening is expandable.

15. A fuel reactor as defined in claim 12, further comprising a plurality of recirculation orifices formed in said conical member of said deflection chamber to allow combustion oroducts to enter said secondary air chamber to preheat air therein.

* * * * *